US008756945B2

(12) United States Patent
Ludvig et al.

(10) Patent No.: US 8,756,945 B2
(45) Date of Patent: Jun. 24, 2014

(54) POWER PLANT COOLING SYSTEM AND A METHOD FOR ITS OPERATION

(75) Inventors: László Ludvig, Budapest (HU); Beatrix Soós, Budapest (HU)

(73) Assignee: GEA EGI Energiagazdalkodasi ZRT., Budapest (HU)

( * ) Notice: Subject to any disclaimer, the term of this patent is extended or adjusted under 35 U.S.C. 154(b) by 107 days.

(21) Appl. No.: 13/513,658

(22) PCT Filed: Dec. 2, 2010

(86) PCT No.: PCT/HU2010/000135

§ 371 (c)(1),
(2), (4) Date: Oct. 26, 2012

(87) PCT Pub. No.: WO2011/067618

PCT Pub. Date: Jun. 9, 2011

(65) Prior Publication Data

US 2013/0055737 A1 Mar. 7, 2013

(30) Foreign Application Priority Data

Dec. 3, 2009 (HU) ..... 0900749

(51) Int. Cl.
*F25B 19/00* (2006.01)

(52) U.S. Cl.
USPC ..... 62/100; 62/268

(58) Field of Classification Search
CPC ..... F25D 31/00; F25D 15/00; F28C 1/00; F25B 2329/41; F25B 49/00; F25B 34/04; F25B 2600/111; F25B 2313/004
USPC ..... 62/100, 268, 270, 271, 121, 169, 183, 62/171; 165/95, 900; 261/24, 28, 29; 60/692, 806
See application file for complete search history.

(56) References Cited

U.S. PATENT DOCUMENTS 3,666,246 A * 5/1972 Cohen ..... 261/151
3,935,902 A 2/1976 Heller et al.

(Continued)

FOREIGN PATENT DOCUMENTS

| | | |
|---|---|---|
| FR | 2222516 | 10/1974 |
| GB | 1016624 | 1/1966 |
| GB | 1059502 | 2/1967 |

OTHER PUBLICATIONS

European Patent Office, International Search Report (3 pgs.), Dec. 14, 2011, Written Opinion of the International Searching Authority (4 pgs.), Notification of Transmittal of the International Search Report and Written Opinion (1 pg.).

*Primary Examiner* — Mohammad M Ali
(74) *Attorney, Agent, or Firm* — Wood, Herron & Evans, LLP

(57) ABSTRACT

The invention is a power plant cooling system comprising a direct contact condenser (11), a cooling tower (12) with at least one heat dissipating unit (13), a pipeline (15) and a cooling water pump (16) suitable for circulating cooling water between the direct contact condenser (11) and the heat dissipating unit (13), as well as a de-aerating structural component (14) defining a de-aerating space adjoining to the top of a flow space of the heat dissipating unit (13). The inventive cooling system comprises a means suitable for maintaining a vacuum in the de-aerating space. The invention also relates to a method for operating the cooling system.

11 Claims, 3 Drawing Sheets

(56) References Cited

U.S. PATENT DOCUMENTS

| | | | | | |
|---|---|---|---|---|---|
| 4,296,802 | A | * | 10/1981 | Larinoff | 165/110 |
| 4,315,404 | A | * | 2/1982 | Schmitt et al. | 60/690 |
| 4,506,508 | A | * | 3/1985 | Coers et al. | 60/652 |
| 4,632,787 | A | * | 12/1986 | Tippmann | 261/30 |
| 4,690,207 | A | * | 9/1987 | Trage et al. | 165/113 |
| 4,893,669 | A | * | 1/1990 | Kashiwada et al. | 165/282 |
| 4,957,276 | A | * | 9/1990 | Garrish | 261/112.1 |
| 5,129,456 | A | * | 7/1992 | Bodas et al. | 165/108 |
| 5,297,398 | A | * | 3/1994 | Meckler | 62/271 |
| 5,306,139 | A | * | 4/1994 | Ozawa et al. | 432/225 |
| 2003/0221436 | A1 | * | 12/2003 | Xu | 62/260 |
| 2005/0223728 | A1 | * | 10/2005 | Stuhlmueller | 62/238.3 |

* cited by examiner

POWER PLANT COOLING SYSTEM AND A METHOD FOR ITS OPERATION

This application claims priority, under Section 371 and/or as a continuation under Section 120, to PCT Application No. PCT/HU2010/000135, filed on Dec. 2, 2010, which claims priority to Hungary Application No. P 0900749, filed on Dec. 3, 2009.

TECHNICAL FIELD

The invention relates to a power plant cooling system and a method for operating thereof.

BACKGROUND ART

The schematic diagram of a conventional Heller-type cooling system or in other words that of an indirect dry cooling system is shown in FIG. 1. The cooling system comprises a direct contact condenser 11, which condenses the spent steam coming from a steam turbine 10 by means of cooling water re-cooled in an indirect dry cooling tower 12. The cooling water warmed up in the direct contact condenser 11 is supplied to the cooling tower 12 in a pipeline 15 by means of a cooling water pump 16 driven by a motor 17.

Heller cooling systems are known which comprise a so-called recuperative water turbine 18 built into the cooling water branch leading from the cooling tower 12 to the direct contact condenser 11. The major task thereof is to absorb usefully the elevating height (drop) which is not needed for returning the cooling water to the direct contact condenser 11. The power recovered on the water turbine 18 contributes to the operation of the motor 17 which drives the cooling water pump 16, thereby reducing the energy need of the motor 17. The motor 17 (electric motor) driving the cooling water pump 16 has two shaft ends. On one side it is coupled to the cooling water pump 16 and on the other side to the water turbine 18, thereby creating a water machine group running with a common axis. Such an approach is disclosed by way of example in the Hungarian patent specification 152 217.

The air flow (draught) necessary for heat transfer is provided by the indirect dry cooling tower 12. The draught can be a natural draught (chimney effect) and it can be an artificial draught (ventilator draught). Prior art cooling towers 12 have one or more heat dissipating units 13 which transfer the heat to be absorbed to the ambient air, and the cooling system also comprises a de-aerating structural component 14 which defines a de-aerating space coupled to the top of the flow space of the heat dissipating unit 13. Generally, prior art heat dissipating units 13 are triangular cooling units (cooling deltas) arranged horizontally or standing vertically along the periphery of the cooling tower 12, and are grouped into sectors, where triangular cooling units associated with a sector have a common cooling water inlet and common de-aerating structural component 14. The common de-aerating structural component 14 generally comprises a de-aerating circular line connecting the top of the triangular cooling units of a sector, and an upright extending de-aerating rack pipe known per se coupled thereto.

In the course of the operation of the conventional Heller-type cooling system, the spent steam coming from the steam turbine 10 is condensed by chilled cooling water supplied to the direct contact condenser 11. For the sake of improving the efficiency of steam recirculation, vacuum has to be ensured in the direct contact condenser 11. It is the cooling tower 12 of an appropriate cooling capacity which ensures to reach this vacuum. As a consequence of the condensation of the exhaust steam, the cooling water is warmed up in the direct contact condenser 11. The warmed up cooling water is removed from the vacuum space of the direct contact condenser 11 by the cooling water pump 16, which then supplies it to the rack pipes located on the top of the triangular cooling units.

The de-aerating rack pipes may even reach 6 to 8 m above the top of the triangular cooling units, and the cooling water level may be 1 to 2 m above the top of the triangular cooling units during operation. The de-aerating rack pipes are opened on the top and hence atmospheric pressure prevails above the cooling water.

The elevating height of the cooling water pump 16 has to be determined in such a way that the cooling water is raised from the vacuum in the direct contact condenser 11 to the atmospheric pressure in the rack pipe, furthermore from the water level of the direct contact condenser 11 to the much higher water level of the rack pipe in such a way that it overcomes the hydraulic resistance of the forward-going branch as well. The driving force of the cooling water flow returning to the direct contact condenser 11 is the pressure difference which prevails between the atmospheric pressure and the vacuum (steam condenser shell pressure) of the direct contact condenser 11, and furthermore the geodetic difference between the water level of the rack pipe and the water level of the direct contact condenser 11. This driving force overcomes the hydraulic resistance of the returning branch and the direct contact condenser 11. The available driving force is, however, much higher than that required for overcoming the hydraulic resistances. To absorb this extra driving power, generally a throttle valve or a much more cost efficient solution, the recuperative water turbine 18 mentioned above, is applied.

It is clear from the above disclosure of the conventional Heller-type cooling system that the cooling water pump 16 is not to be designed for overcoming the hydraulic resistance of the whole cooling water circuit, but for a higher load. Therefore, it is necessary to have the water turbine 18 so that the unnecessary elevating height (drop) can be utilised relatively cost efficiently (much more efficiently than by using throttle). However, the application of the water turbine 18 necessarily entails loss, too, resulting from the loss of the cooling water pump 16 and the water turbine 18.

DESCRIPTION OF THE INVENTION

The object of the invention is to provide a power plant cooling system and a method of operation thereof, which reduce or eliminate the disadvantages of prior art solutions. The object of the invention is especially to create a power plant cooling system and a method of operation thereof which enable the reduction or elimination of the unnecessary elevating height (drop) in the return branch of the cooling water and eliminate the necessity of applying a recuperative water turbine. In such a way, the power necessary for circulating the cooling water can be reduced and the application of a cooling water pump with a lower elevating height is possible.

The invention is based on the recognition that if in the inner space of a de-aerating structural component—opening to atmospheric pressure according to the prior art—a lower than atmospheric pressure, i.e. a vacuum is maintained, the objects of the invention can be achieved.

Consequently, the invention is a power plant cooling system according to claim 1 or an operation method according to claim 8. Preferred embodiments of the invention are defined in the dependent claims.

BRIEF DESCRIPTION OF THE DRAWINGS

Exemplary preferred embodiments of the invention will be described hereunder with reference to drawings, where.

MODES OF CARRYING OUT THE INVENTION

Figure 1:
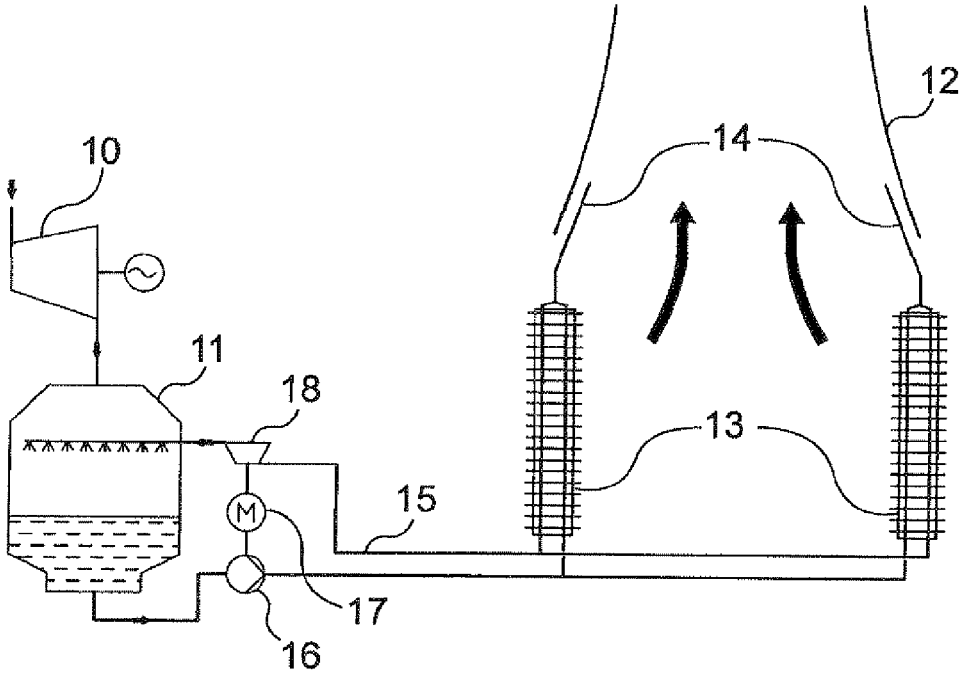
FIG. 1 is a schematic diagram of a prior art Heller-type power plant cooling system.

One characteristic of the approach used by the invention is that a subatmospheric pressure, a vacuum is created in the heat dissipating units 13, i.e. in the rack pipes at the top of the triangular cooling units. According to the invention, the definition of vacuum—as usually applied in this field of art—is a pressure generated in the steam condenser shell of the direct contact condenser 11, which pressure is always lower than the atmospheric pressure, for example it is typically below 0.3 bar. Maintaining vacuum or any rate of subatmospheric pressure in the de-aerating space defined by the de-aerating structural component 14 entails the advantage that the cooling water pump 16 does not have to overcome the atmospheric pressure also in the forward-going branch, and accordingly the driving force of the cooling water in the return branch will also be lower.

The power plant cooling system according to the invention consequently comprises a means which is able to keep the pressure in the de-aerating space at a rate lower than the atmospheric pressure, which is preferably a vacuum maintaining means.

By way of example, the invention can be implemented in two especially preferred embodiments. The common characteristic of these embodiments is that the means suitable for maintaining the vacuum in the de-aerating space comprises a vacuum sealed valve designed to seal controllably the de-aerating space of the de-aerating structural component from the ambient air, and a vacuum line coupled to the de-aerating space.

According to the first embodiment shown in FIG. 2, the vacuum tight valve 19 is arranged close to the top of the triangular cooling units, hence the vacuum line 20 coupled below and only shown conventionally adjoins the de-aerating space below the water level which is created as a result of maintaining vacuum in the de-aerating space. Preferably, one vacuum sealed valve 19 is used in each sector, and they are preferably fixed on the rack pipes making the part of the de-aerating structural component 14.

The vacuum tight valves 19 are closed by launching the operation of the cooling system, even before the triangular cooling units are filled up, and vacuum is generated in the triangular cooling units via the vacuum line 20. Then the part of the de-aerating structural component 14 located below the vacuum tight valve 19 represents the space in which the lower than atmospheric pressure, vacuum is maintained. After filling up the triangular cooling units, in an operating state, the space below the vacuum tight valve 19 is filled up with cooling water.

Figure 2:
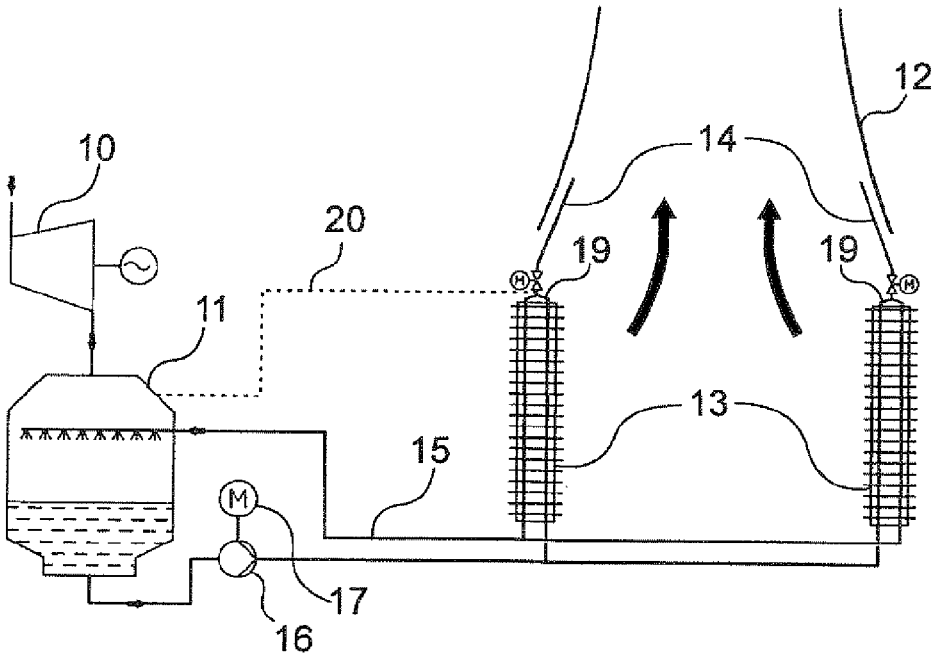
FIG. 2 is the schematic diagram of a power plant cooling system according to a first embodiment of the invention.
Figure 3:
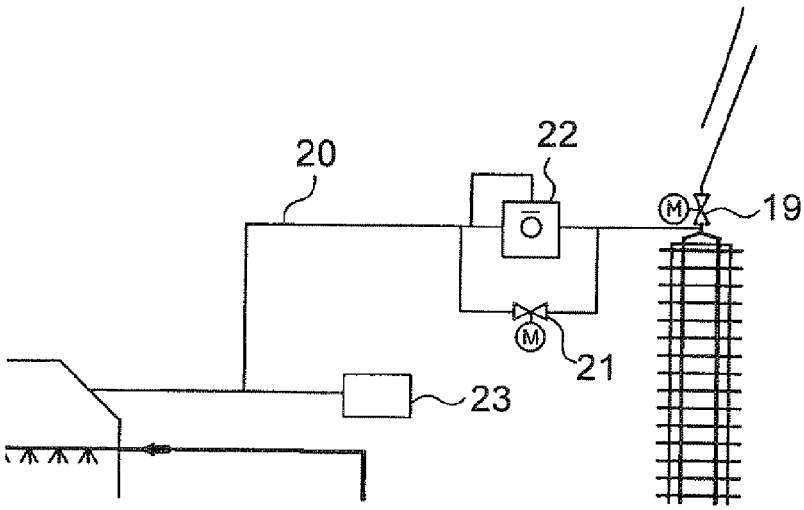
FIG. 3 is a magnified and supplemented schematic diagram of a detail of FIG. 2.

FIG. 3 shows a magnified and further detailed section of FIG. 2. The vacuum line 20 is connected to the vacuum generating means 23, preferably a so-called ejector, which also makes sure that the direct contact condenser 11 is under vacuum. The vacuum line 20 comprises a controllable exhaust valve 21, which is opened during the creation of vacuum when the operation is started. As a de-aerating unit, a ball valve 22 on the top of the flow chamber of the heat dissipating unit 13 enabling a relatively smaller throughput is serving to transfer the air eventually accumulated during the operation.

The sectors of the heat dissipating units 13, preferably triangular cooling units, are to be drained from time to time. This could be necessary, for example, at the time of maintenance and when a frost risk prevails. In such cases the controllable and motorised vacuum tight valves 19 are opened and the vacuum line 20 is separated by valve control from the de-aerating space, when providing its traditional function that the de-aerating circular line integrated in the de-aerating structural component 14 and the associated upright protruding de-aerating rack pipe enable the draining of cooling water from the triangular cooling units.

Figure 4:
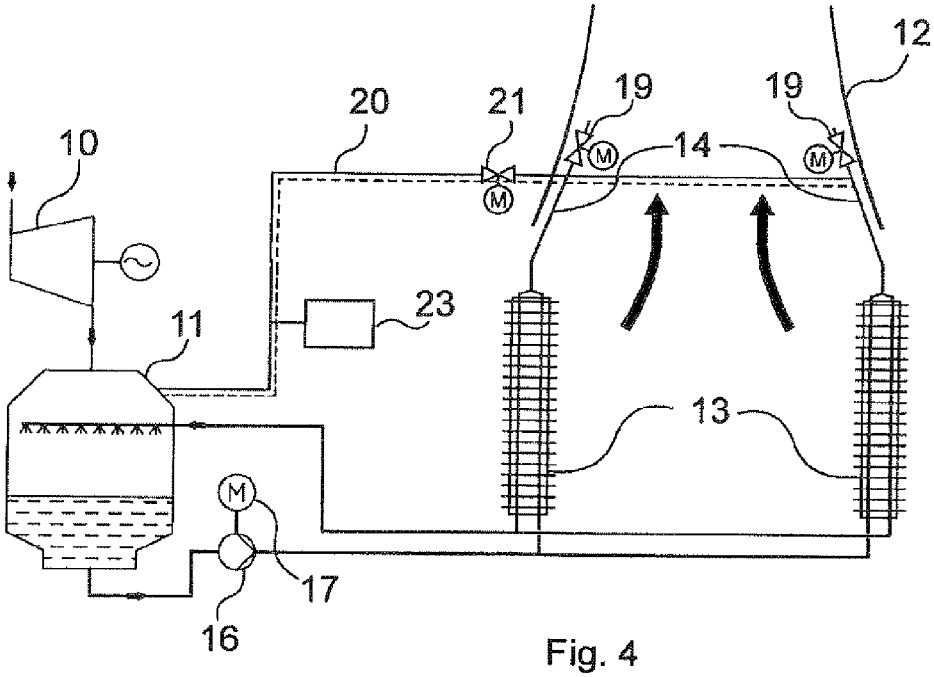
FIG. 4 is the schematic diagram of a power plant cooling system according to a second embodiment of the invention.

In the second preferred embodiment shown in FIG. 4, the vacuum line 20 is coupled to the de-aerating space, i.e. preferably to the rack pipe, above the water level that prevails in case of vacuum maintenance in the de-aerating space. Putting the system under vacuum/draining is implemented as described above, by the appropriate control of the vacuum tight valves 19 and the exhaust valve 21.

The vacuum line 20 subjects suction effect to the de-aerating rack pipe, which raises the height of the water column in the rack pipe. The de-aerating structural component 14 as well as the rack pipe preferably integrated therein should be installed at such a height that the suction effect does not yet draw the cooling water into the steam condenser shell of the direct contact condenser 11.

Figure 5:
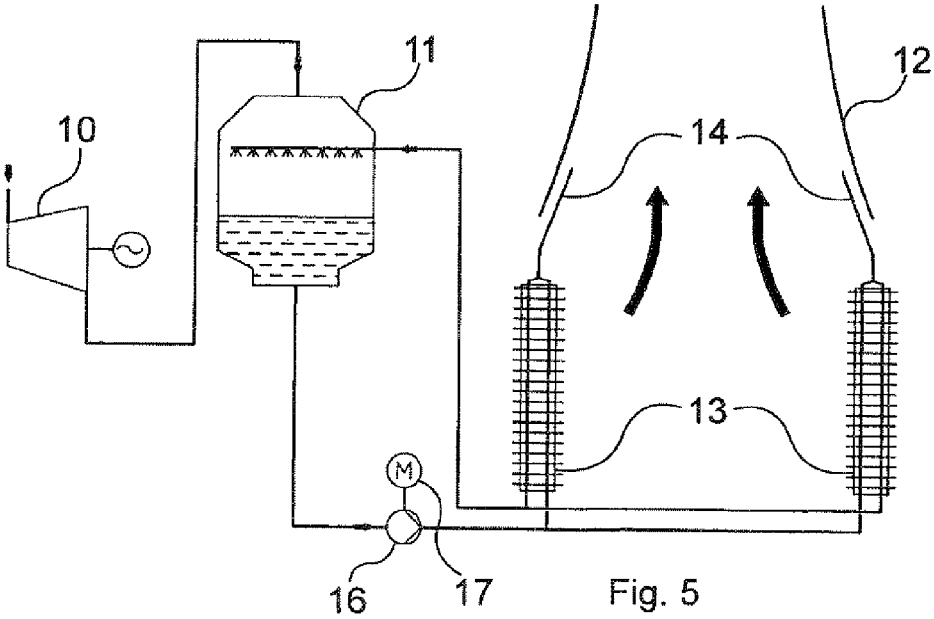
FIG. 5 is the schematic diagram of a further preferred solution.

It is easy to see that the solution according to the invention may be combined also with an approach whereby the water level in the direct contact condenser 11 is raised; such an approach is shown in FIG. 5 (where, for the sake of simplicity, the vacuum, i.e. the subatmospheric pressure generating unit is not shown). With the water level of the direct contact condenser 11 being hence raised, the extra elevating height (drop) evolving in the return branch of the cooling system can be reduced or even eliminated in the given case.

This approach can be applied especially in the case of the steam turbines 10 having a lateral, axial or upward outflow. The water level of the direct contact condenser 11 can be raised by locating the direct contact condenser 11 proper at a higher vertical position or by increasing the volume of water therein.

The higher the water level of the direct contact condenser 11, the more the unnecessary extra elevating height (drop) can be reduced. The water level in the direct contact condenser 11 is preferably kept above the lower third of the vertical extension of the heat dissipating unit 13, or more preferably above its halving level, and even more preferably above its topmost level.

The creation of vacuum at the top of the triangular cooling units and the raising of the water level in the direct contact condenser 11 provide broad combination options for the optimal use of local endowments. Both the approach according to FIG. 2, and the approach according to FIG. 4 may be combined with the arrangement depicted in FIG. 5.

The invention, of course, is not limited to the above detailed embodiments, but further modifications and variations are possible within the scope defined by the claims. For example, instead of the de-aerating rack pipe, a de-aerating tank located in an appropriate vertical position can also be used.

The invention claimed is:

1. A power plant cooling system comprising a direct contact condenser a cooling tower with at least one heat dissipating unit, a pipeline and a cooling water pump suitable for circulating cooling water between the direct contact condenser and the heat dissipating unit, and a de-aerating structural component defining a de-aerating space adjoining to the top of a flow space of the heat dissipating unit, characterised by comprising means for maintaining a vacuum in the de-aerating space.

2. The cooling system according to claim 1, characterised in that the means for maintaining a vacuum in the de-aerating space comprises a vacuum tight valve for controllably closing the de-aerating space of the de-aerating structural component from the ambient air, and a vacuum line connected to the de-aerating space.

3. The cooling system according to claim 2, characterised in that the vacuum line is connected to the de-aerating space above a water level prevailing in case of vacuum maintained in the de-aerating space.

4. The cooling system according to claim 2, characterised in that the vacuum line is connected to the de-aerating space below a water level prevailing in case of vacuum maintained in the de-aerating space, and air eventually accumulating at a top of a flow space of the heat dissipating unit is exhausted by means of a de-aerating device connected to the vacuum line, preferably a ballpoint valve.

5. The cooling system according to claim 3, characterised in that heat dissipating units are arranged along the periphery of the cooling tower, which are grouped into sectors, wherein the heat dissipating units associated with a sector are provided with a common cooling water inlet and a common de-aerating structural component.

6. The cooling system according to claim 5, characterised in that the heat dissipating units are triangular cooling units, the common de-aerating structural component comprises a de-aerating circular line connecting the top of the triangular cooling units associated with a sector and an associated upright protruding de-aerating rack pipe, and the means for maintaining a vacuum is coupled to the de-aerating rack pipe.

7. The cooling system according to claim 1, characterised in that the water level in the direct contact condenser is preferably kept above a lower third of a vertical extension of the heat dissipating unit, more preferably above its halving level, and even more preferably above its topmost level.

8. A method for operating a power plant cooling system, the cooling system comprising a direct contact condenser, a cooling tower with at least one heat dissipating unit, a pipeline and a cooling water pump suitable for circulating cooling water between the direct contact condenser and the heat dissipating unit, and a de-aerating structural component coupled to a de-aerating space adjoining to the top of a flow space of the heat dissipating unit, characterised in that a vacuum is maintained in the de-aerating space.

9. The method according to claim 8, characterised in that in the de-aerating space the vacuum is maintained by a vacuum tight valve suitable for controllably closing the de-aerating space of the de-aerating structural component from the ambient air, and by a vacuum line connected to the de-aerating space.

10. The method according to claim 9, characterised in that at the start of the operation of the cooling system, the vacuum tight valve is closed before the vacuum develops in the direct contact condenser.

11. The method according to claim 8, characterised in that the water level in the direct contact condenser is kept above a lower third of a vertical extension of the heat dissipating unit, preferably above its halving level, and more preferably above its topmost level.

* * * * *